United States Patent [19]

deJong et al.

[11] Patent Number: 4,824,387

[45] Date of Patent: Apr. 25, 1989

[54] BIASED FLOATING CONNECTOR

[75] Inventors: Peter C. deJong, Harrisburg; Robert W. Elicker, Dillsburg; Thomas J. Zola, Harrisburg, all of Pa.

[73] Assignee: AMP Incorporated, Harrisburg, Pa.

[21] Appl. No.: 117,167

[22] Filed: Nov. 4, 1987

Related U.S. Application Data

[63] Continuation-in-part of Ser. No. 897,186, Aug. 15, 1986, Pat. No. 4,755,149.

[51] Int. Cl.[4] ..... H01R 13/62; H01R 13/74

[52] U.S. Cl. ..... 439/248; 439/557

[58] Field of Search ..... 439/247, 248, 557, 558, 439/567, 565

[56] References Cited

U.S. PATENT DOCUMENTS

| | | | |
|---|---|---|---|
| 1,987,035 | 1/1935 | Tidemen | 439/557 |
| 2,891,103 | 6/1959 | Swengel | 174/153 |
| 3,179,738 | 4/1965 | Delyon | 174/50 |
| 3,281,753 | 10/1966 | Fink | 339/49 |
| 3,289,145 | 11/1966 | Ruehlemann et al. | 339/176 |
| 3,337,836 | 8/1967 | Churla, Jr. | 339/49 |
| 3,391,376 | 7/1968 | Hammell et al. | 339/17 |
| 3,543,219 | 11/1970 | Pautrie | 339/91 |
| 3,560,908 | 2/1971 | Dell et al. | 339/91 |
| 3,790,923 | 2/1974 | Mathe | 339/128 |
| 3,824,524 | 7/1974 | Glover | 339/60 |
| 3,941,444 | 3/1976 | Bruni et al. | 339/60 |
| 3,989,343 | 11/1976 | Lucius et al. | 339/128 |
| 4,389,021 | 6/1983 | Coldren | 339/126 |
| 4,443,048 | 4/1984 | Moist, Jr. | 339/63 |
| 4,560,227 | 12/1985 | Bukala | 439/557 |
| 4,755,149 | 7/1988 | deJong et al. | 439/248 |

FOREIGN PATENT DOCUMENTS 0020834 6/1979 European Pat. Off. .

OTHER PUBLICATIONS

AMP Incorporated Document IS7982, Rel. 02-13-84.

*Primary Examiner*—Gary F. Paumen

*Attorney, Agent, or Firm*—David L. Smith

[57] ABSTRACT

A biased floating mount connector (10) when mounted to a panel (48) assumes a biased first position prior to mating with a complementary connector (26) and is capable of moving against the bias in a plane transverse to axial alignment of contacts therein to a second position during mating with the complementary connector (26).

10 Claims, 3 Drawing Sheets

BIASED FLOATING CONNECTOR

This application is a continuation-in-part of application Ser. No. 897 186, filed Aug. 15, 1986, now U.S. Pat. No. 4,755,149.

BACKGROUND OF THE INVENTION

This invention relates to a biased floating mount connector, and in particular to a receptacle which, when mounted in a panel such as a printed circuit board, assumes an equilibrium, biased first position prior to mating with a header and is capable of moving against the bias in a plane transverse to axial alignment of contacts therein to a second position during mating with a header.

Prepositioning a floating connector within a predetermined range of travel while maintaining the connector parallel to a panel on which the connector is mounted has heretofore been inadequate for blind mating.

SUMMARY OF THE INVENTION

The present invention provides a receptacle mountable to a panel having aperture means therein. The receptacle defines a housing having contact receiving passages extending rearward from a mating face. The receptacle further has a first pair of resilient mounting means which engage a first surface of the panel and bias, the housing away from the panel and a second pair of resilient mounting means that pass through aperture means in the panel, engage the other surface of the panel and bias the housing toward the panel. The floating mount receptacle thus is maintained in a biased equilibrium position, prior to mating, with the receptacle parallel to the panel. The floating mount receptacle is incrementally moveable against the bias during mating to a complementary connector to align for mating.

DESCRIPTION OF THE PREFERRED EMBODIMENT

Figure 1:
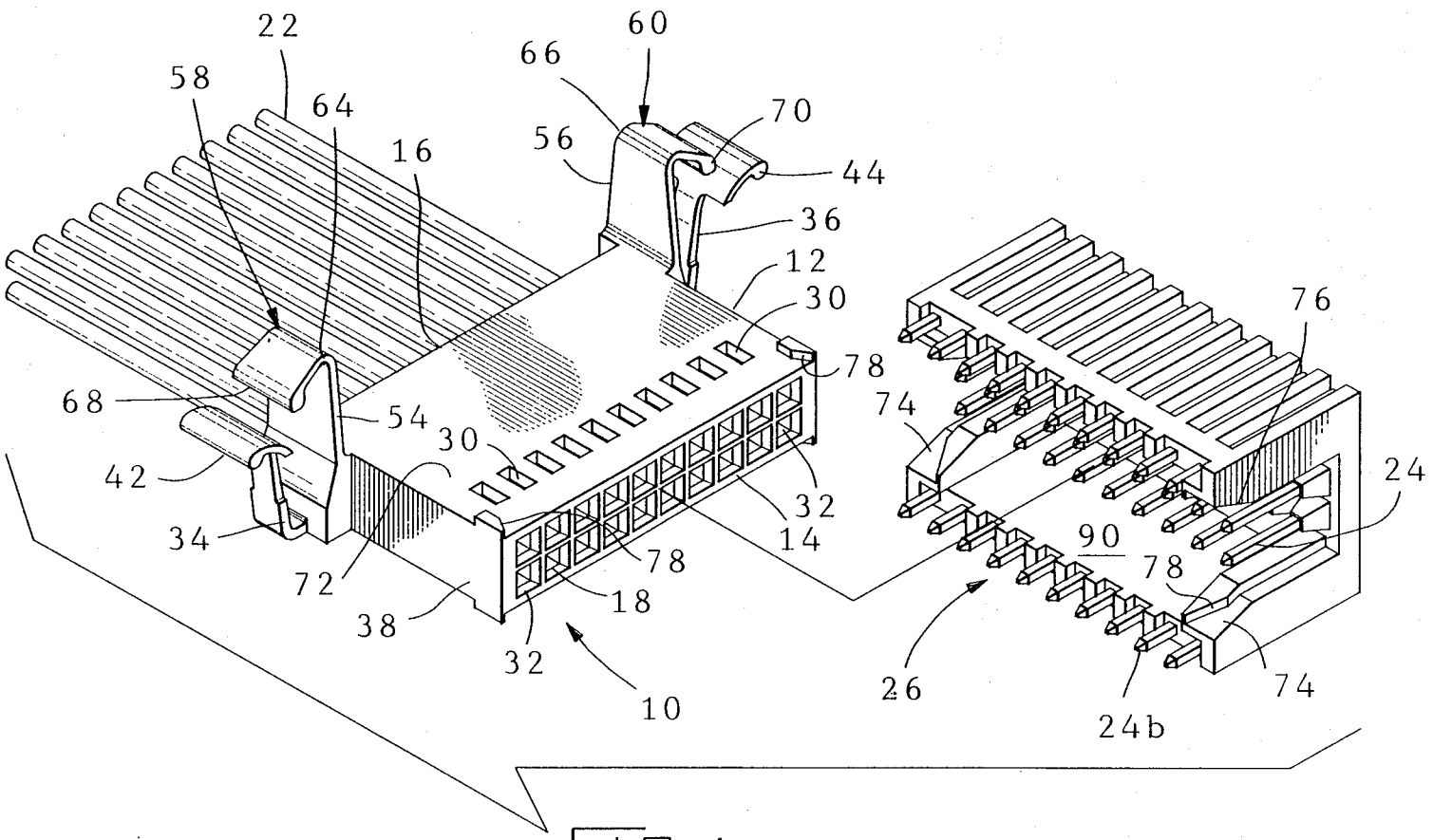
FIG. 1 is a perspective view of a biased floating mount receptacle in accordance with the present invention, along with a mating header.

Referring the the drawing, initially to FIG. 1, a biased floating mount receptacle 10 in accordance with the present invention is shown. Receptacle 10 includes a housing 12 molded of a suitable dielectric material and has forward mating face 14, an opposed conductor receiving rear face 16, and contact receiving passages 18 extending therebetween with contacts 20 secured therein.

Contacts 20 are terminated to insulated electrical conductors 22 and received in passages 18 for electrical engagement with posts 24 within header 26. Lances 28 (not shown) are disposed in apertures 30 of housing 12 to prevent withdrawal of contacts 20. Passages 18 have tapered lead-in surfaces 32 to facilitate insertion of posts 24.

Receptacle 10 has a pair of resilient first mounting means 34, 36 extending from opposed sidewalls 38, 40 of housing 12 to free ends 42, 44 respectively. Free ends 42, 44 are adapted to engage the lower surface 46 of printed circuit board 48 on which receptacle 10 is shown mounted in FIG. 2. Free ends 42,44 engage lower surface 46 adjacent apertures 50,52.

Also extending from opposed sidewalls 38, 40 near rear face 16 so as not to interfere with receptacle 10 mating with header 26 is a pair of resilient second mounting means 54, 56. Resilient second mounting means 54, 56 extend generally in the same direction relative to housing 12 as first mounting means 34, 36. Second mounting means 54, 56 have forward ends 58, 60 which extend beyond upper surface 62 and are flexible for insertion through apertures 50, 52.

Forward ends 58, 60 have a bight section 64,66 which reverses the direction of the second mounting means 54, 56 and a free end 68, 70 which extends from bight section 64, 66 to engage upper surface 62 adjacent apertures 50, 52.

Prior to mounting receptacle 10 to printed circuit board 48, free ends 42, 44 would not be biased downward by lower surface 46 and would therefore extend upwardly from upper surface 72 of housing 12 further than the distance between lower surface 46 and upper surface 72 when receptacle 10 is mounted to printed circuit board 48.

Similarly, free ends 68, 70 of resilient second mounting means 54, 56 are biased upwardly away from upper surface 72 by upper surface 62 in the mounted position as compared to the unmounted position.

Figure 2:
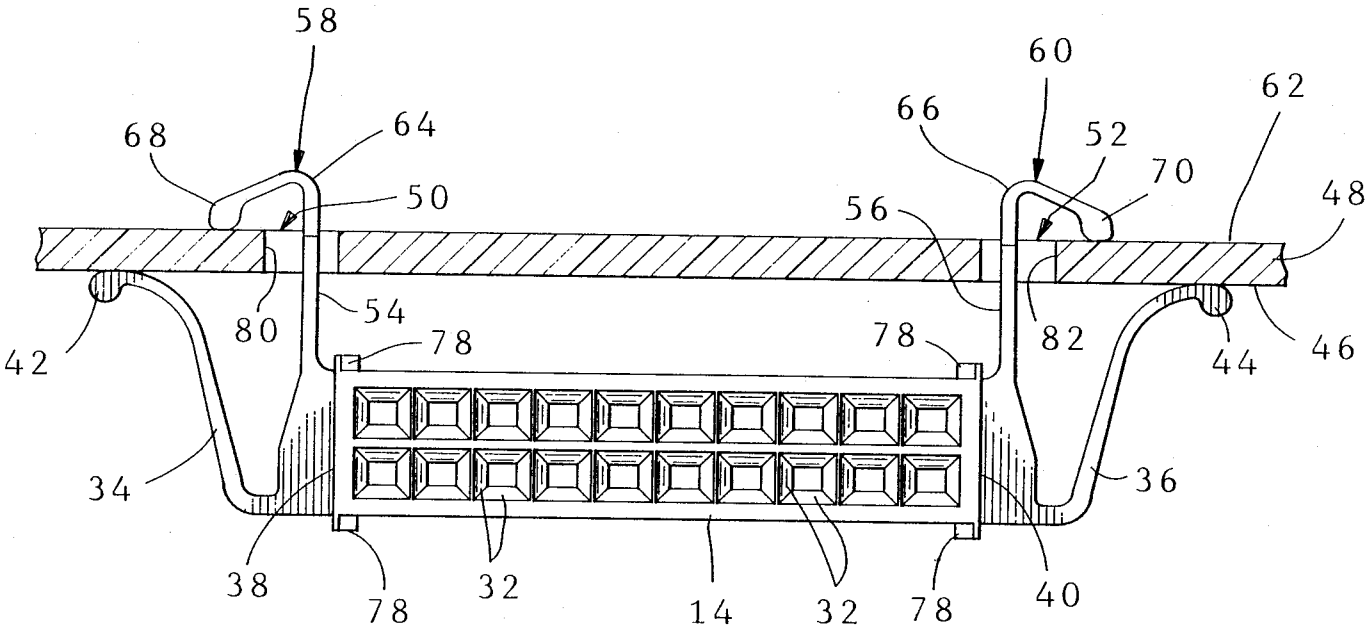
FIG. 2 is a front view of a biased floating mount receptacle mounted in apertures in a printed circuit board.

These biases thus cause housing 12 to be biased respectively away from and toward printed circuit board 48 upon mounting thereto assuming a first, unmated position at equilibrium with respect to the biases, and incrementally moveable against the biases to a second position relative to printed circuit board 48 upon mating with header 26. The receptacle is thus moveable, vertically as shown in FIG. 2, toward and away from the printed circuit board a predetermined amount to accommodate mating with header 26. The vertical movement of receptacle 10 allows the receptacle to align with header 26 for mating and is caused by engagement of housing 12 with vertical guide means during mating. In a preferred embodiment, the vertical guide means are surfaces 74 and 76 of header 26, with engagement between surface 74 and housing 12 causing receptacle 10 to move toward printed circuit 48 board while engagement between surface 76 and housing 12 causes receptacle 10 to move away from printed circuit board 48.

Once mounted to printed circuit board 48, receptacle 10, upper surface 72, contact receiving passages 18 and contacts 20 are thus maintained parallel to printed circuit board 48 even during movement of receptacle 10 to align for mating. Resilient first mounting means 34, 36 and resilient second mounting means 54, 56 may be designed with spring constants to preposition receptacle 10 at a predetermined equilibrium position within the vertical moveable range of receptacle 10.

Receptacle 10, is laterally self centering upon mounting to printed circuit board 48 but also may move laterally in apertures 50, 52, as shown in FIG. 2, to align with header 26 for mating. Lateral movement is caused by engagement of lateral guide means during mating. In a preferred embodiment, the lateral guide means are tapered surfaces 78 which engage cooperating structure on header 26 to urge receptacle 10 to move laterally to align during mating. Lateral movement of receptacle 10 is limited by resilient second mounting means 54, 56 engaging walls 80, 82 of apertures 50, 52 respectively. Receptacle 10 could be mounted to a single aperture in printed circuit board 48.

In a preferred embodiment, no movement of receptacle 10 in the direction of mating, that is along the axis of contact receiving passages 18 or contacts 20, is permitted to accommodate alignment and mating.

Figure 3:
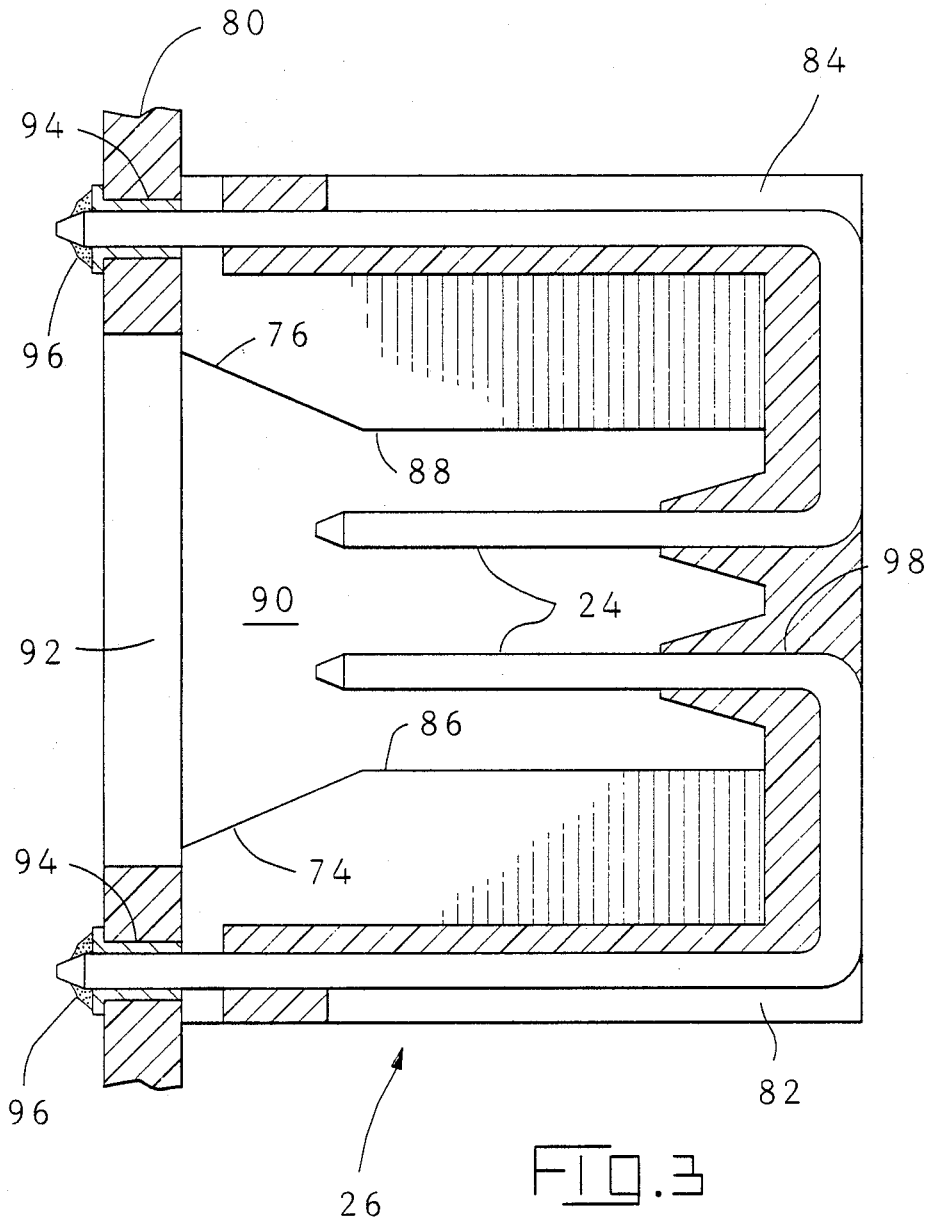
FIG. 3 is an enlarged cross-section of the header shown in FIG. 1, mounted to a printed circuit board.

Header 26, shown in a perspective view in FIG. 1 and in cross-section mounted to printed circuit board 80 in FIG. 3, is also molded of a suitable dielectric material and may take many forms. Header 12 may have a single or multiple row configuration of pins 24 typically corresponding to the number of rows of contacts of receptacle 10.

Header 26 is generally of a U-shape cross-section having two legs 82, 84 typically of equal length but possibly of different cross sectional area forming a pair of spaced parallel walls 86, 88 defining therebetween a cavity 90 for receiving receptacle 10 through aperture 92 in printed circuit board 80. Although legs 82, 84 may have the same cross section, for through board mounting applications providing leg 82 with a greater cross section than leg 84 permits through holes 94 in board 80 into which ends 24 b of posts 24 are soldered 96 to be a greater distance from aperture 92.

Posts 24 are frictionally disposed in apertures 98 thence bent 90 degrees, with one row of posts 24 bending in a first direction and the second row of posts 24 bending in a second direction into a post seating channel as more completely described in co-pending commonly assigned application Ser. No. 897,186 filed Aug. 15, 1986, which application is hereby incorporated by reference.

The cooperating structure that is engaged by lateral guide means 78 may take the form of the sidewalls.

We claim:

1. A connector mountable to a panel, said panel having opposed first and second major surfaces and aperture means extending therebetween, said connector comprising:

a housing having contact receiving passages therein, said housing adapted to be mounted to the panel with said contact receiving passages extending parallel to the major surfaces of the panel, said housing adapted to be movable toward and away from the panel during mating with a complementary connector;

a spaced pair of resilient first means extending from the housing to first free ends adapted to engage the first major surface of the panel at respective spaced first locations proximate the aperture means;

a spaced pair of resilient second means extending from the housing to respective forward ends insertable through the aperture means, each said forward end including a bight section and an end section extending from the bight section to a second free end adapted to engage the second major panel surface, said second free ends engageable with the second major surface of the panel at respective second locations proximate the aperture means, and prior to said connector being mounted to the panel, said first free ends extend further from a surface of said connector housing than after mounting to the panel and are deflectable toward said connector housing by the first major surface of the panel upon mounting thereto, and said second free ends extend closer to a surface of said connector housing before said connector is mounted to the panel than after mounting thereto and are deflectable away from said connector housing by the second major surface of the panel upon mounting thereto, whereby upon mounting said connector to the panel, said resilient first means engage the first major surface of the panel such that the connector housing is biased away from the panel by said pair of resilient first means, said resilient second means extend through the aperture means to engage the second major surface of the panel such that the connector housing is biased toward the panel by said pair of resilient second means, said connector housing assuming a first unmated position with respect to the panel and incrementally moveable against said biases to a second position relative to the panel upon mating with a complementary connector.

2. A connector as recited in claim 1 wherein the aperture means define wall means and the second resilient means engage the wall means to define a limit on lateral movement of the connector.

3. A connector as recited in claim 1 further comprising contacts received in said contact receiving passages.

4. A connector as recited in claim 1 further comprising lateral guide means on said housing for engaging a complementary connector and for causing the connector to move laterally in the aperture means to align during mating of the connector with said complementary connector.

5. A connector as recited in claim 1 wherein said housing has sidewalls, said pair of resilient first means and said pair of resilient second means extend from said sidewalls.

6. A connector mountable to a panel, said panel having opposed first and second major surfaces and aperture means extending therebetween, said connector comprising:

a housing having contact receiving passages therein, said housing adapted to be mounted to the panel with said contact receiving passages extending parallel to the major surfaces of the panel, said housing adapted to be moveable toward and away from the panel during mating with a complementary connector;

a spaced pair of resilient first means extending from the housing to first free ends adapted to engage the first major surface of the panel at respective spaced first locations proximate the aperture means;

a spaced pair of resilient second means extending from the housing to respective forward ends insertable through the aperture means, each said forward end including a bight section and an end section extending from the bight section to a second free end adapted to engage the second major panel surface, said second free ends engageable with the second major surface of the panel at respective second locations proximate the aperture means, whereby upon mounting said connector to the panel, said resilient first means engage the first major surface of the panel such that the connector housing is biased away from the panel by said pair of resilient first means, said resilient second means extend through the aperture means to engage the second major surface of the panel such that the connector housing is biased toward the panel by said pair of resilient second means, said connector housing assuming a first unmated position with respect to the panel and incrementally moveable against said biases to a second position relative to the panel upon mating with a complementary connector.

7. A connector as recited in claim 6 wherein the aperture means define wall means and the second resilient means engage the wall means to define a limit on lateral movement of the connector.

8. A connector as recited in claim 6 further comprising contacts received in said contact receiving passages.

9. A connector as recited in claim 6 further comprising lateral guide means on said housing for engaging a complementary connector and for causing the connector to move laterally in the aperture means to align during mating of the connector with said complementary connector.

10. A connector as recited in claim 6 wherein said housing has sidewalls, said pair of resilient first means and said pair of resilient second means extend from said sidewalls.

* * * * *